VARIABLE FLOW ELASTIC NOZZLE

BACKGROUND OF THE INVENTION

1. Field of the Invention

The present invention relates generally to the field of fluid mechanics and more particularly to the measurement and regulatinon of flow in apparatus for preparing mixtures of fluids (liquid and/or gas), such as, for the preparation of a fuel mixture for combustion engines.

2. Description of the Prior Art

In devices having a throttling means, generally called a nozzle or venturi, changes in fluid flow entail a variation in flow velocity if the "throat" is fixed in cross section.

Devices with venturis of variable throat section used for flow regulation, notably in internal combustion engine carburetors, are known. They are generally formed mechanically with movable parts making up the walls of a venturi and controlled in position by the regulating means. Among their disadvantages are the poor aerodynamics of the flow channel, leading to losses in pressure and parasitic turbulence, and their low sensitivity and fidelity in response to the factors of regulation, due to their mechanical nature.

SUMMARY OF THE INVENTION

The goal of the present invention is to remedy these defects and to modify the flow velocity at will by varying the circular section of the throat by the external action of the pressure, or by the underpressure, of a control fluid, without the friction and the inertia response in the known mechanical systems, particularly in the regulation of carburetors with a variable venturi.

According to the invention, a nozzle with a variable section venturi is characterized by the fact that at least one wall element in the zone of the throat of the venturi is constituted by at least one elastic wall which is deformable under the action of the pressure of a control fluid.

The invention is applicable to numerous devices, improving or modifying their characteristics, such as, flowmeters, mixers, flow regulators, and the like. The wall element in the zone of the venturi throat is constituted by at least one elastic, deformable wall which encloses a space subjected to the control pressure which deforms the wall into a shape equalizing the static pressure of the control fluid and the dynamic pressure of the regulated fluid flowing through the venturi.

The elastic wall can consist of an elastic sleeve which internally forms a passage for the fluid stream to be regulated and encloses a circular space where the pressure of the control fluid is exerted. It can likewise consist of an elastic bulb situated on the axis of the passage for the fluid being cotrolled, the interior of the bulb being subjected to the pressure of the control fluid.

The flow of a homogeneous fluid in a conduit is disturbed by variations in the cross-section thereof and by obstacles present in the section, the result being larger pressure losses as the divergence of the shape of the section from circular or from the ideal convergent-divergent development of a circular-section conduit becomes greater.

This preferential shape can be achieved by locally doubling the deformable wall with at least a second deformable enclosure subjected to the pressure of at least one control fluid.

The invention is particularly adaptable to a device for preparing the fuel mixture of a motor, significantly improving it. In this case, conditions are even more perturbed by pulsation of the flow and, from the throat on, by inhomogeneity of a fluid composed of more or less humid air and fuel. The fuel may be in the form of a gas, a vapor or of variable sized droplets.

This is why in certain types of carburetors called "constant vacuum" types, permitting variation of the "throat" section is detrimental to the conditions of flow, with consequent significant pressure loss, especially at low openings with an unfavorable effect on the motor's charging efficiency.

The ideal shape for a venturi with a variable throat section is, therefore, a surface of revolution deformable in a continuous but rapid and sensitive manner under the instantaneously varying conditions of operation of the carburetor. This deformable elastic shape can be realized using a synthetic material impervious to gas and resistant to liquid or gaseous hydrocarbons at the operating temperatures. Synthetic rubbers used in gaskets subjected to such conditions are particularly suitable.

In a standard carburetor, the flow of the mixture is controlled by the position of the butterfly valve, except for the "idle." Such a butterfly valve also plays an important role in the initial opening for passing from "idle" to "normal" speed.

It is a question, then, of an indispensable device in a single-barrel carburetor. According to a particular realization of the invention, it is possible to eliminate the butterfly valve of the second barrel in a two-barrel carburetor. In this case, the "venturi" variable by elastic deformation in accordance with the invention acts as the butterfly valve, the section of the throat being controlled either by the vaccuum or by a suitable linkage to the accelerator pedal, as a function of the parameters of the regulation of the power and the RPM of the motor.

According to the invention, a variable venturi arrangement can likewise be associated with an injection arrangement in an intake duct, with the characteristic of obtaining a more suitable air flow in the fuel injection zone to produce a perfectly homogeneous mixture. The duct has a variable-section elastic nozzle in the axis of which is situated a diffuser into which issues the jet of an injector snychronized in operation with the opening of the intake valve.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein:

FIG. 6 shows the application of a deformable central spindle-shaped element in a two-barrel carburetor.

CARBURETOR CHOKE VALVE POSITIONER

Figure 1:
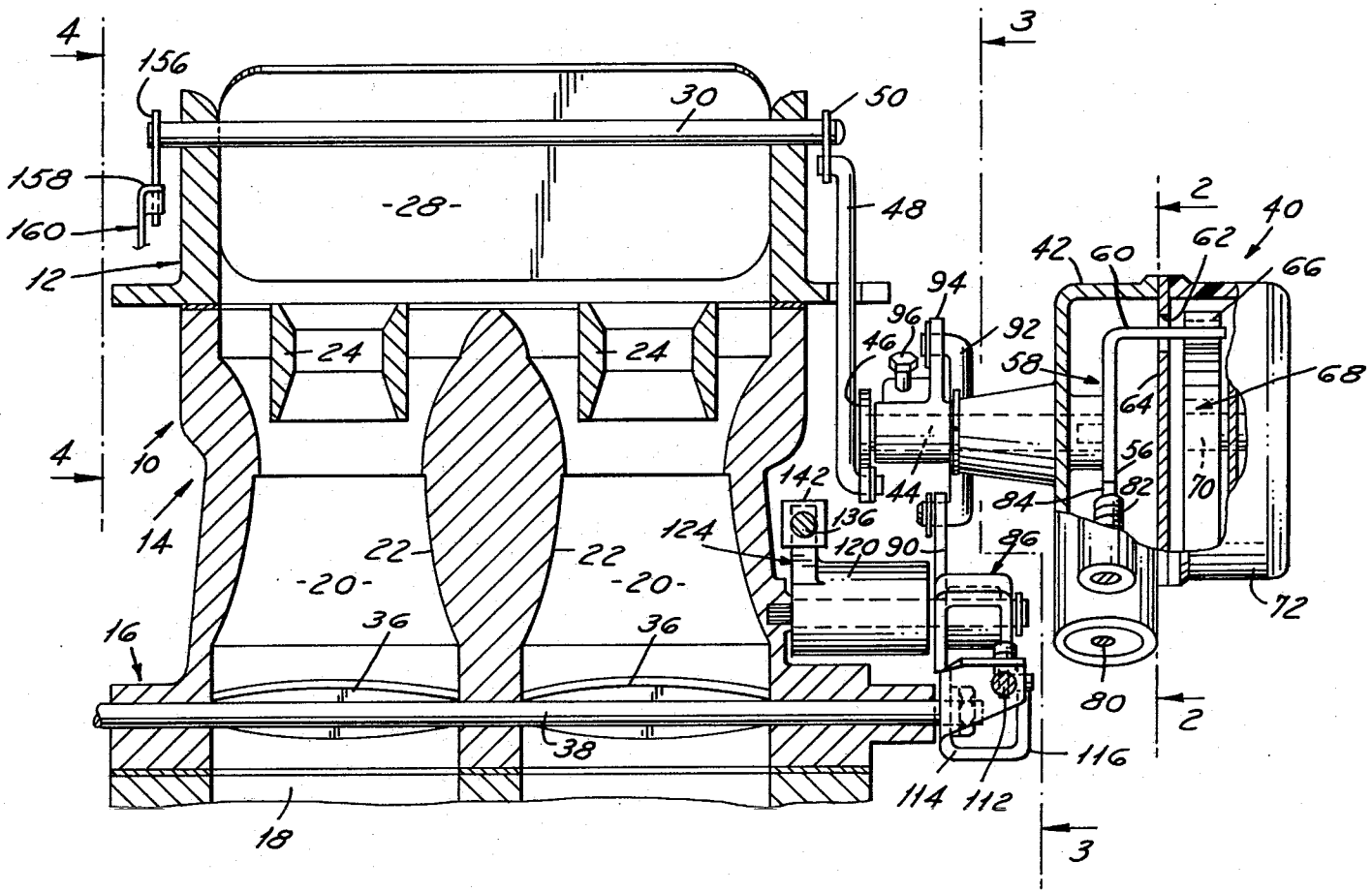
FIG. 1 is a diagram, partly in section, of a variable nozzle according to the present invention having a deformable annular element.

This invention relates, in general, to a choke valve positioner for an automotive type carburetor. More particularly, it relates to one that is operable automatically to determine the open position of the choke valve during cold weather operation without the necessity of the usual engine manifold vacuum pulldown servo.

Most commercial automotive type carburetors have an automatic choke that includes a thermostatically coiled spring to close the choke valve with a force that increases with decreases in temperature from the engine normal operating level. During cold weather, after an engine start is made, the air/fuel mixture should be leaned from the over-rich starting mixture to provide better engine performance and less emission of undesirable unburned hydrocarbons, etc. into the atmosphere. Generally, an engine manifold vacuum operated pulldown servo is attached to the choke or valve plate so that as soon as the engine reaches running condition, the increased vacuum level attained is sufficient to crack upon the choke plate to provide the desired leaning. With such a construction, however, altitude and other factors play a part in determining the vacuum level obtainable, and, therefore, the degree of opening of the choke valve after cranking operation.

This invention eliminates the above disadvantages by providing a choke construction in which the choke valve is free to fall by gravity to an open position or by air flow against it, and the choke plate pulldown position is determined by mechanical means cooperating with a conventional thermostatically coiled spring that is sensitive to temperature changes to urge the choke valve in a closed direction when operating conditions are below the engine normal operating temperature level.

It is an object of the invention, therefore, to provide a carburetor with a choke construction that is accurate and reliable in operation, one that opens the choke valve progressively as the temperature conditions increase towards a predetermined level, and one that operates independently of engine intake manifold vacuum to provide the desired setting of the choke valve for all cold engine operating temperature levels.

It is another object of the invention to provide a carburetor choke construction of the type described above that includes a choke valve that is unbalance mounted to fall by gravity to an open position or be moved open by air flow against it, interconnected with a thermostatically responsive choke valve pulldown mechanism that will automatically position the choke valve open to the desired degree as a function of the temperature level to provide the most efficient air/fuel ratio to the mixture flowing into the engine cylinders.

It is a further object of the invention to provide a choke construction of the type described that includes a modulating spring that acts in opposition to the conventional thermostatically coiled spring that urges the choke valve closed with a force that increases with decreases in temperature from the predetermined engine normal operating temperature level, the modulating spring decreasing its effectiveness with increases in temperature and the force of which is adjustable so as to vary the operating positions of the choke valve during cold engine operating condition.

Figure 2:
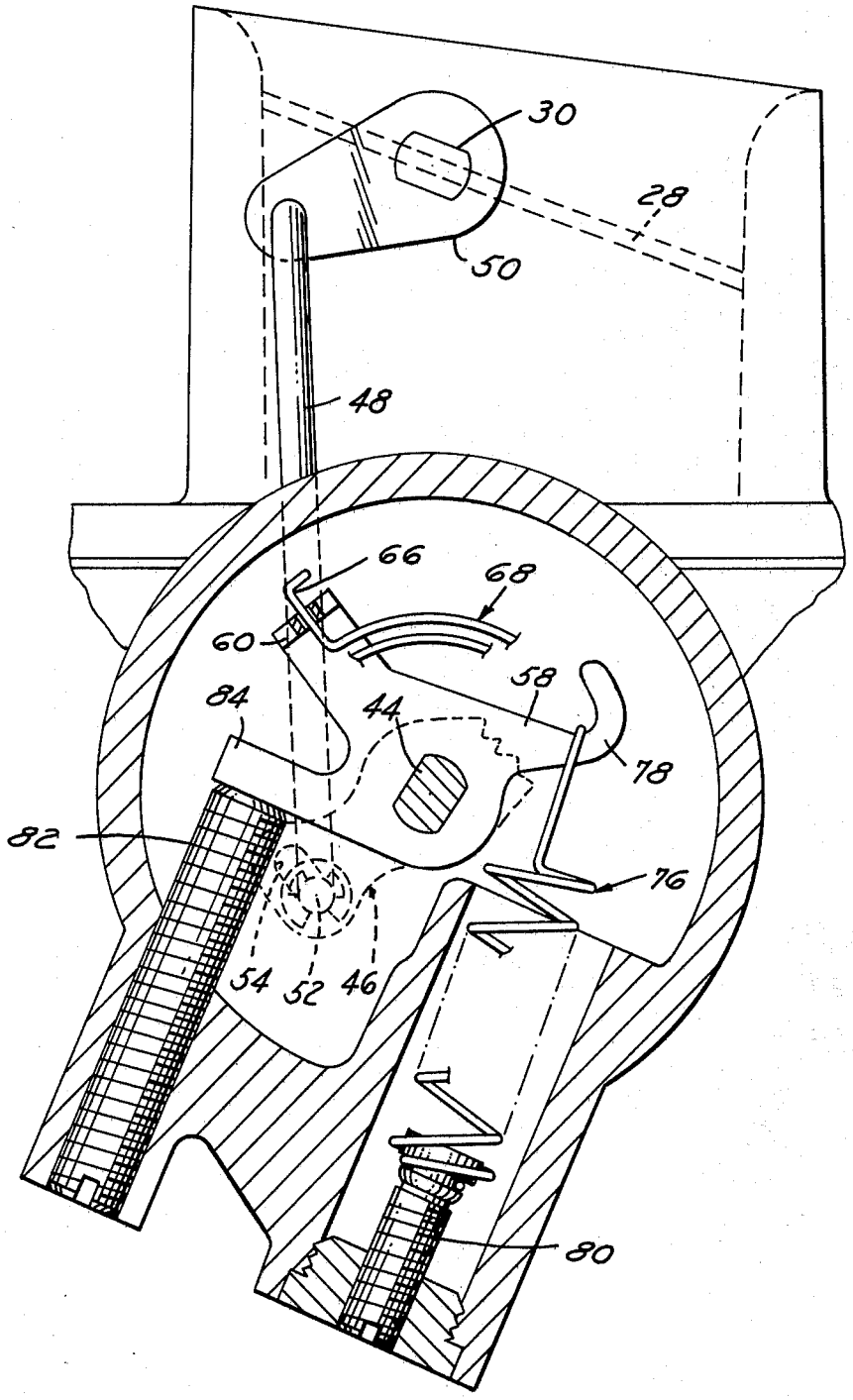
FIG. 2 is a section view of a variable nozzle with a deformable control spindle-shaped element.
Figure 3:
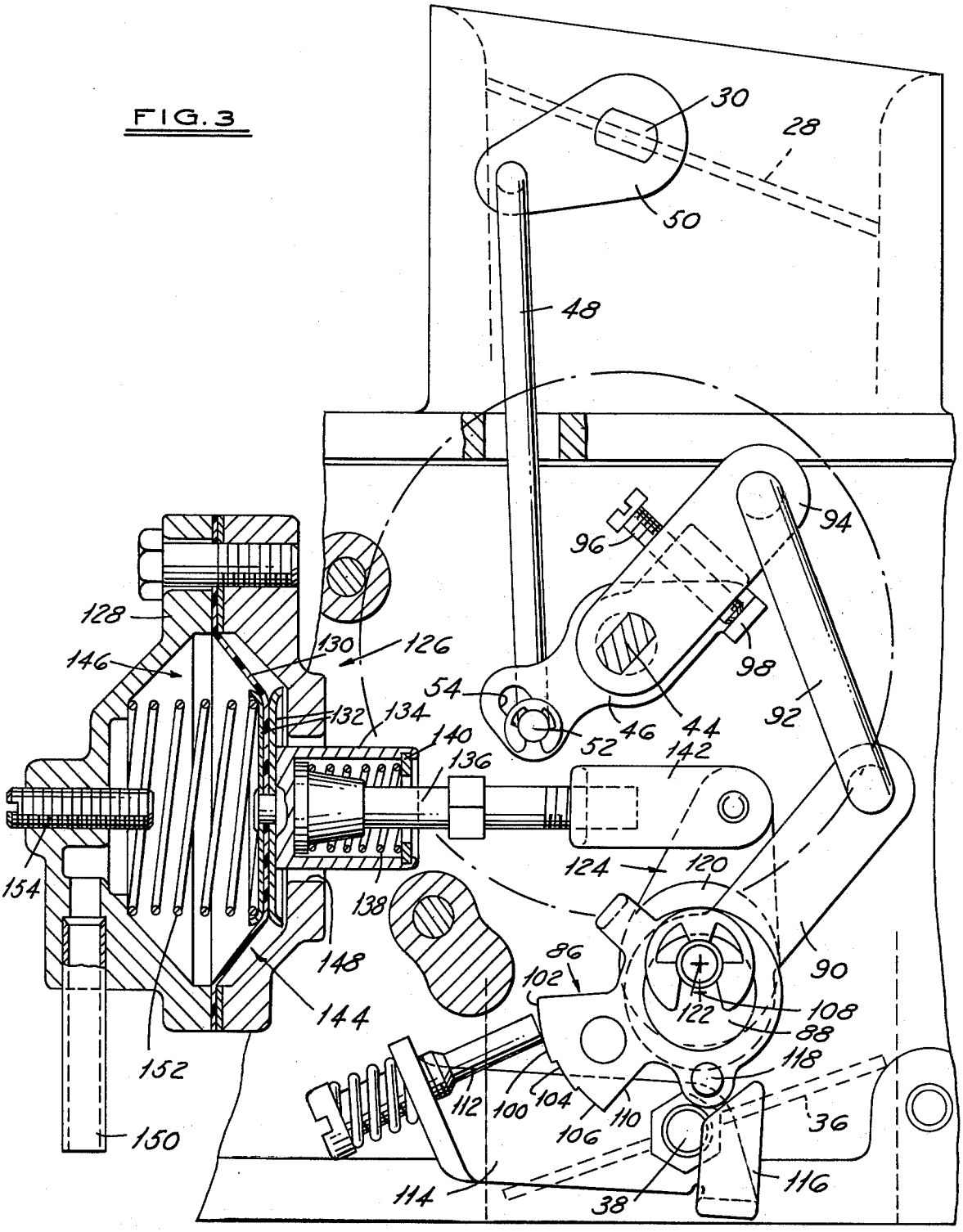
FIG. 3 shows a variable nozzle with a deformable central ogival element.
Figure 4:
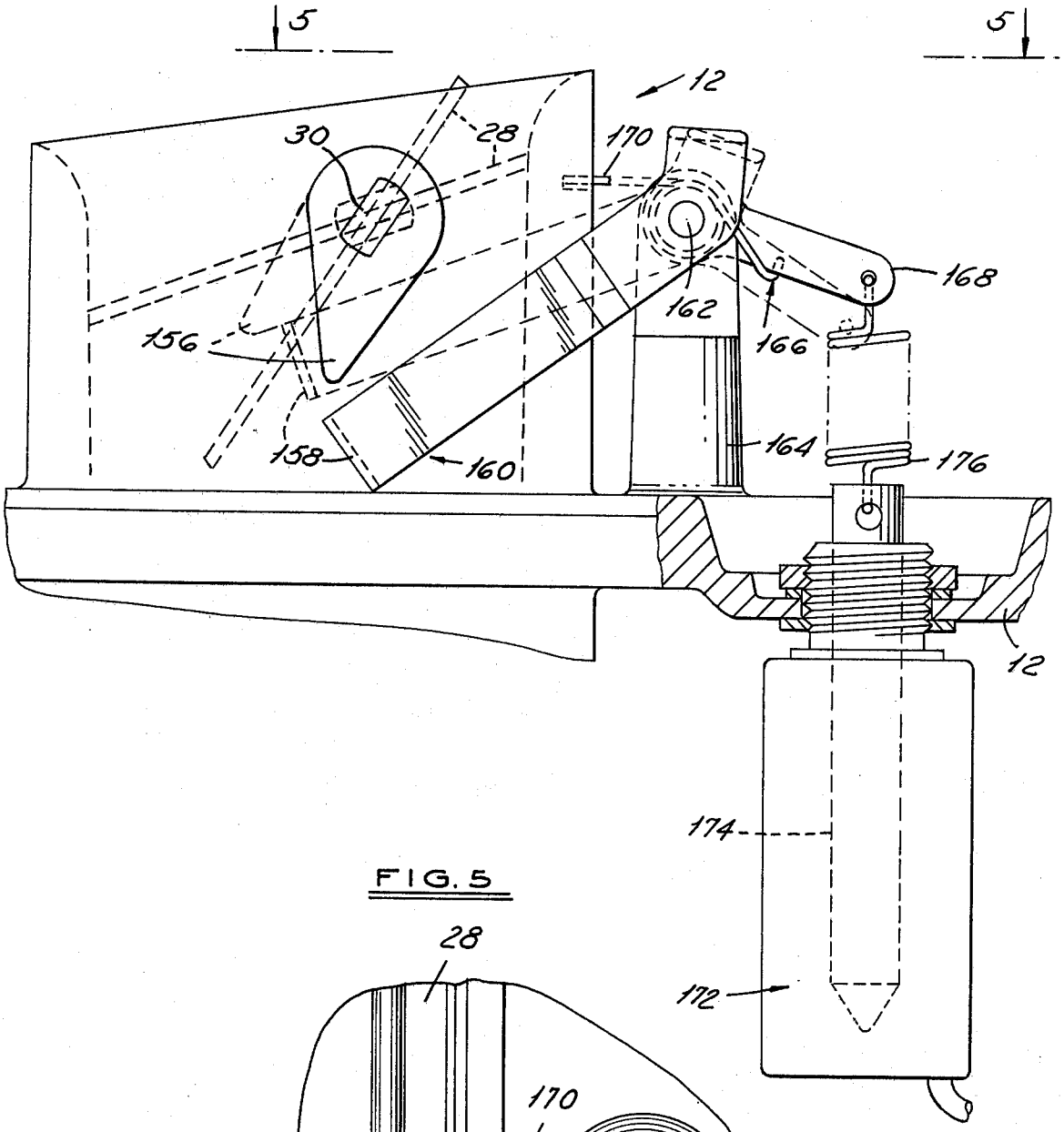
FIG. 4 shows the application of a deformable annular element in a two-barrel carburetor.
Figure 5:
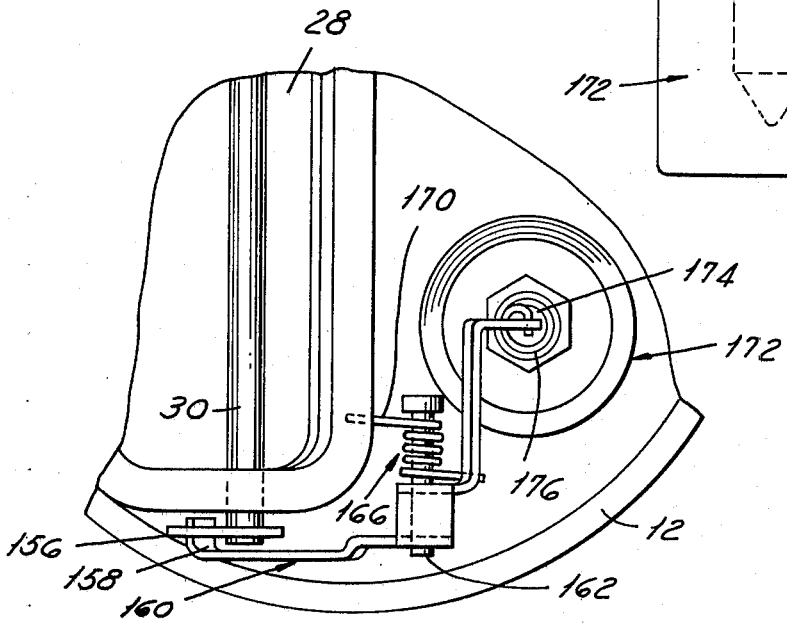
FIG. 5 shows the application of a deformable annular element in an intake duct with injection.

Other objects, features and advantages of the invention will become more apparent upon reference to the succeeding detailed description thereof, and to the drawings illustrating the preferred embodiment thereof, wherein:

FIG. 1 is a cross-sectional view of a portion of a carburetor embodying the invention:

FIGS. 2, 3 and 4 are side elevational views, on an enlarged scale, with parts broken away and in section, of portions of the FIG. 1 showing taken on planes indicated by and viewed in the direction of the arrows 2—2, 3—3 and 4—4, respectively, of FIG. 1; and, FIG. 5 is a top plan view of a detail of FIG. 4 viewed in the direction of the arrows 5—5 of FIG. 4.

FIG. 1 is obtained by passing a plane through approximately one-half of a known type of two-barrel, downdraft carburetor 10. It includes an air horn section 12 secured to a main body portion 14, and a throttle body 16. The throttle body is mounted over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi section 22 in which is suitably mounted a boost venturi 24.

Air flow into passages 20 is controlled by a choke valve 28 that is unbalance mounted on a shaft 30. The choke valve thus may fall open by gravity or be urged to an open position by air flow against it. Shaft 30 is rotatably mounted in side portions of the carburetor air horn, as shown. Flow of the usual fuel and air mixture through each passage 20 is controlled by a conventional throttle valve 36 fixed on a shaft 38 rotatably mounted in the throttle body 16. The throttle valves are rotated in the usual manner by depression of the conventional vehicle accelerator pedal. They move from the idle speed or essentially closed positions shown to wide open positions essentially at right angles to that shown.

Choke valve 28 rotates from the closed position shown in FIGS. 1 and 2 to a nearly vertical, wide open, essentially inoperative position. In this latter position, the choke valve provides a minimum obstruction to airflow. The rotative position of choke valve 28 is controlled in part by a mechanical operating mechanism 40 located on one side of the carburetor. The latter includes a hollow choke housing portion 42 that is bolted, by means not shown, to cast extensions of the carburetor main body portion 14. The housing is apertured for rotatably supporting one end of a choke valve control shaft 44, the other end fixedly mounting a bellcrank-type lever 46 (see FIG. 3). The latter is pivotally connected by a link 48 to a lever 50 fixed on choke valve shaft 30.

It should be noted that lever 46 and link 48 are interconnected by a lost motion means (FIGS. 2 and 3) consisting of the right angled end 52 of link 48 constituting a pin engagable in an elongated slot 54 formed in lever 46. It will be clear that rotation of shaft 44 in either direction as seen in FIGS. 2 and 3 will rotate choke valve 28 in a corresponding direction. This will open or close the carburetor air intake, as the case may be, once the pin end 52 has moved to one or the other end of slot 54, as the case may be. The purpose of this arrangement will become clearer later.

The end of shaft 44 that projects into housing 42 has fixed on it the body portion 56 of a thermostatic spring lever 58. The lever has one portion 60 that projects outwardly at right angles and through a slot 62 in an insulating gasket 64. It has a bifurcated end that engages the end 66 of a thermostatically responsive, bimetallic, coiled spring element 68. The inner end portion of the coiled spring is fixedly secured on the end of a nipple 70 formed as an integral part of a choke cap 72 of heat insulating material.

The thermostatic spring element 68 will contract or expand as a function of changes in temperature of the air in the chamber 76 defined within cap 72 and housing 42. Accordingly, changes in temperature from the normal engine operating level will circumferentially move end 66 of spring lever 58 to rotate shaft 44 and lever 48 in one or the other directions, as the case may be. The force of bimetallic spring 68 is chosen such that at the engine normal operating temperature, the circumferential movement of the spring will have moved the choke valve 28 to a wide open vertical position. Decreases to levels below the normal temperature will progressively increase the biasing force on the choke valve in a closing direction.

As seen in FIG. 2, opposing the force of spring 68 is a modulating tension spring 76. It is hooked at its upper end to an extension 78 of spring lever 58 and anchored at its opposite end to an adjustable screw 80. The force of modulating spring 76 is chosen such that at temperature levels between 60° and 100° F, the spring force will exceed the torque or closing biasing force of thermostatic spring 68. The position at which thermostatic spring 58 and tension spring 76 are in equilibrium will determine the position of spring lever 58.

As shown in FIG. 2, the thermostatic spring normally biases lever 58 against an adjustable stop 82. The latter determines the cold engine minimum pulldown or engine running position of choke valve 28. That is, the coldest position of the end 66 of thermostatic spring 68 will position an extension 84 of spring lever 58 against stop 82, and locate lever 46 as shown. The most the choke valve 28 then can open is to fall by gravity or be moved by airflow against it to move the pin end 52 of link 48 upwardly to the top of slot 54. As the temperature rises to above 65° F, however, the modulating force of tension spring 76 causes the levers 58 and 46 to be moved clockwise to new equilibrium positions, as stated above, which increases the choke pulldown for choke valve 28. Thus, it allows the choke valve to have a greater opening that is more in line with the leaner air/fuel ratio the warmer temperature level is calling for to maintain the engine running.

At some warm engine temperature level around 100° F, for example, the force equilibrium between springs 68 and 76 will be such as to permit spring 76 to retract to its dead height, and thereafter have no effect on the decreasing closing force of thermostatic spring 68. The adjustability of screw 80 will determine the amount of modulating force applied to thermostatic spring 68, and also the temperature range over which the modulation will occur.

During cold engine operation, it is necessary to open throttle valves 36 from their normal, essentially closed idle speed positions to allow enough extra air/fuel mixture into the engine to prevent it from stalling due to the extra friction, greater viscosity of the lubricant, etc. Then as the engine warms, it is desirable to progressively close the throttle valves to the idle speed positions to reduce engine speed. As best seen in FIGS. 1 and 3, a fast idle cam 86 is rotatably mounted on a shaft 88. The cam has a lever 90 projecting from one side that is pivotally connected by a link 92 to a second lever 94. The latter is rotatably mounted on shaft 44 and adjustably mounts a screw 96. The screw has a one-way engagement with a finger or right angle tab 98 that is integral with and projects laterally from choke lever 46. The weight and location of lever 94, link 92, lever 90 and fast idle cam 86 is such that the cam will always fall by gravity in a clockwise direction so that screw 96 will follow the movement of tab 98 of lever 46. This will effect rotation of the fast idle cam clockwise or counterclockwise progressively as the temperature of thermostatic spring 64 increases or decreases, respectively.

The opposite side of fast idle cam 86 is formed with an edge 100 having in this case, three circumferentially contiguous steps, a high cam step 102 and lower cam steps 104 and 106. Each step in counterclockwise circumferential succession is defined by a face that is of less radial extent from the axis of rotation 108 of the cam than the previous one, the lower step 106 being followed by an opening 110. The steps and opening constitute abutments or stops in the path of movement of a screw 112. The latter is adjustably mounted on a lever 114 fixed on throttle shaft 38. The radial depth of opening 110 is chosen such that when the fast idle cam is rotated to permit movement of screw 112 into the opening 110, throttle valves 36 then will be permitted to rotate their engine normal operating temperature level idle speed positions essentially closing the induction passages. Engagement of the screw 112 with each of the steps 106, 104 and 102 as the cam is rotated counterclockwise upon temperature decreases, then will progressively locate the idle speed position of the throttle valves at more open positions.

The fast idle cam is repositioned for a cold start to its fastest idle speed position by depressing the conventional accelerator pedal to open the throttle valves to move abutment screw 112 away from the face of cam 86. That is even though the engine temperature may decrease to a level calling for counterclockwise rotation of fast idle cam 86 by the thermostatic spring 68, if screw 112 engages steps 104 or 106, the frictional resistance between the two prevents rotation of the cam.

A kickdown operation of a warm engine is also provided. Depressing the conventional accelerator pedal to the floor rotates the throttle valve shaft 38 a maximum amount. Fixed on the throttle shaft is an actuator 116 which when rotated engages a pin 118 projecting from the fast idle cam 86. The movement of the pin moves the fast idle cam and through links and levers 90, 92, 94, 46, 48 and 50 opens choke valve 28 to relieve the flooded or rich mixture stall condition by leaning the mixture.

The choke valve usually is positioned essentially closed for cold engine starts. This lessens airflow and increases the vacuum fuel metering signal to draw in enough extra fuel to provide sufficient vapor for starting the engine. Once the engine fires, however, the throttle plates must be open enough to permit the engine to draw in enough fuel and air to raise the engine cranking speed of say 100 r.p.m. to a 1,000 r.p.m. fast idle speed that will sustain engine operation. Once the engine running operation is attained, then the overrich starting mixture no longer is required and it becomes desirable to reduce both the choke valve and throttle plate openings to lower settings, but still ones that provide a richer setting than that which provides the normal idle speed when the engine has warmed up.

The position of the throttle valve, therefore, is important. The more it is cracked open from the closed position during engine cranking operations, the greater the volume of air and fuel inducted. Therefore, for engine starts, the throttle valve stop screw 112 is scheduled to be located against the high step 102 of fast idle cam 86 to provide the richest cranking air/fuel mixture. Once the engine has started, however, then the throttle valves are automatically closed down by a small amount that will reduce the airflow and consequently the engine idling speed, without disengaging the throttle valve stop or abutment from the high step of the fast idle cam.

More particularly, the fast idle cam is eccentrically secured on the end of a shaft 120 rotatably mounted in the carburetor body and having an axis of rotation 122. Secured to the opposite end of shaft 120 is a lever 124 that is pivotally connected to a manifold vacuum actuated servo 126.

The servo 126 consists of a hollow two-piece housing 128 between which is edge mounted an annular flexible diaphragm 130. A pair of retainers 132 are riveted to the diaphragm and to the cup shaped housing 134 of a flexible connector assembly. Slidable within housing 134 is an actuating rod 136, the base of which is formed as a seat for a spring 138. The opposite end seats against a retaining ring 140. Rod 136 is screwed to an adaptor 142 that is pivotally connected to lever 124.

Servo diaphragm 130 divides housing 128 into an air chamber 144 and a vacuum chamber 146. Air at ambient pressure communicates with chamber 144 through the opening 148. A tube 150 connects engine manifold vacuum from any suitable source to vacuum chamber 146. A spring 152 normally urges diaphragm 130 and thus the fast idle cam 86 to the positions shown.

In brief, when the engine starts, manifold vacuum is communicated to the vacuum side of diaphragm 130 via tube 150. As diaphragm 130 strokes leftwardly, compressing spring 152, lever 124 is rotated about center 122. Fast idle cam 86, having its center of rotation at point 108 on shaft 88, moves rightwardly as diaphragm 130 strokes leftwardly. Due to throttle return cable and other throttle closing forces, screw 112 is held in contact with and follows the rightward movement of fast idle cam 86. This closes down the throttle valves. Therefore, by using a diaphragm motor to eccentrically reposition the fast idle cam, automatic and gradual speed decay is achieved.

Adjustment of rod 136 qualifies the diaphragm assembly to the eccentric lever 124. Adjustment of screw 112 determines the cranking throttle angle, and also the engine run-up speed that will occur before manifold vacuum is realized by diaphragm 130. By employing delay restrictors, not shown, between manifold vacuum tube 150 and diaphragm 130, the elapsed time for automatic speed decay can be varied to suit any calibration. Adjustment of stop screw 154 sets the stroke of diaphragm 130 and the subsequent speed to which the engine will run down after start-up. If adjusting screw 112 is in contact with any step on cam 86, the initial run-up speed will be higher than the after automatically reduced speed established by the step radius. If adjusting screw 112 is not in contact with fast idle cam 86, the idle speed will be as determined by the conventional throttle anti-dieseling solenoid or idle speed adjusting screw, not shown.

As stated previously, the start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. Once the engine does start, however, then the choke valve should be opened slightly to lean the mixture to prevent engine flooding as a result of an excess of fuel.

The mechanisms shown in FIGS. 4 and 5 and indicated partially on the left hand side of the carburetor in FIG. 1 accomplishes this objective.

The choke valve shaft 30 has a lever 156 fixed to it for cooperation with the right angled tab end 158 of an actuating lever 160. Lever 160 is pivoted on a shaft 162 mounted on a pedestal 164. A return spring 166 is hooked against one arm portion 168 of lever 160, the opposite end 170 of the spring being anchored in the choke housing. Spring 166 urges lever 160 downwardly out of engagement with choke shaft lever 156 to permit the choke valve 28 to fall open by gravity or be forced open by the air load or air flow against it, to a position as dictated by the pulldown mechanism described in connection with FIG. 2.

The choke valve 28 is forceably closed during engine starts, i.e., the cranking cycle, by a conventional solenoid 172. The latter is adjustably mounted on the carburetor air horn 12 and has a slidable armature 174. The armature is connected by an extending spring 176 to arm 168 of lever 160. The solenoid is wired by a lead 178 to the engine ignition or starting circuit, not shown, so that it will be energized whenever the ignition switch is turned to the start position and deenergized when the ignition switch is released to the engine running position.

With the ignition switch in the start position, solenoid 172 pulls in extending spring 176 and actuating lever 160. When rotated about pivot 162, the tab end 158 of lever 160 contacts lever 156, as seen in dotted lines, closing choke valve 28. In order to achieve engine speed run-up, spring 176 extends against the air load on choke valve 28. At this point, the driver realizes the engine is running and he releases the ignition switch. With a hold-in force no longer applied at solenoid 172, spring 170 returns lever 160 to its deenergized position so that the choke valve 28 can rotate freely as the engine warms up.

For starts in ambient temperatures above 100° F, the thermostatic spring 68 will have positioned choke valve 28, and likewise lever 156 to the full line position shown so that when solenoid 172 is energized, the end 158 of lever 160 no longer will contact lever 156, and the choke valve will remain open.

In overall operation, except for FIG. 4, the parts are shown in the positions they attain when the engine is conditioned for a start or cranking operation below 100° F. As seen in FIG. 4 in dotted lines, when the engine ignition switch is turned to the on or start position, solenoid 172 is energized and pulls down on extending spring 176. This moves the actuating lever 160 up against the edge of lever 156 and positively closes the choke valve. At the same time, as seen in FIG. 2, the thermostatic spring 68 has pushed lever 58 against the minimum stop 82, which predetermines the minimum pull-down opening of the choke valve. As soon as the driver realizes that the engine is running, he releases the ignition switch which then deenergizes solenoid 172 and allows choke valve 28 to drop by gravity and air load against it. As seen in FIGS. 2 and 3, the choke lever link 48 is free to move within slot 54 of lever 46 so that the degree of opening is determined by the position of lever 46 and lever 58. Accordingly, the choke valve will move to a slightly cracked open position which allows more air to enter the carburetor to lean out the previously rich starting mixture.

Simultaneously, as seen in FIG. 3, rotation of thermostatic spring 68 in the choke valve closing direction locates the lever 46 as shown thereby moving the fast idle cam linkage 94, 92 and 90 to its counterclockwisemost position shown. Upon depression of the conventional accelerator pedal, the throttle valve shaft 30 rotates to release fast idle screw 112 from engagement with the fast idle cam face 100, thereby permitting the fast idle cam to be moved to the position shown aligning the high step 102 with screw 112. No vacuum exists in tube 150 so that servo 126 is in the position shown eccentrically rotating the fast idle cam axis 108 clockwise about the axis 122 of lever 124. This locates the fast idle cam leftwardly its maximum amount so that the throttle lever screw 112 causes the throttle valves 36 to be opened the maximum amount desired for a cold engine start.

Assume now that the engine has fired. The firing vacuum is still insufficient to move servo 126 so that the throttle valves remain in the positions indicated in FIG. 3. As soon as the engine reaches sustained operation, however, the manifold vacuum present in tube 150 moves diaphragm 130 leftwardly to pivot lever 124 about its axis 122. This simultaneously moves the eccentrically mounted fast idle cam 86 counterclockwise about the axis 122 as seen in FIG. 3. In effect, the fast idle cam moves rightwardly, with the throttle lever screw 112 remaining in contact with the high step face 102 to slightly close down the throttle valves by an increment that decreases the air flow through the carburetor and thus reduces the fast idle speed of the engine. From this point forward, so long as the engine remains running, all fast idle action will occur as a result of pivotal movement of the fast idle cam 86 about its axis 108 rather than a lateral movement of the cam.

As the engine warms, the end 62 of thermostatic spring 68 will move arcuately or circumferentially clockwise so as together with the force of modulating spring 76 rotate levers 58 and 46 clockwise to progressively open the choke valve wider. At the same time, as seen in FIG. 3, the clockwise rotation of lever 46 permits the fast idle cam linkage to follow and accordingly rotate the fast idle cam clockwise. This will progressively present the lesser radial extent steps 104, 106 and finally opening 110 for engagement with throttle lever screw 112. This will progressively decrease the throttle valve openings until the screw finally engages in recess 110 of the fast idle cam, at which point the throttle valves will have closed to their engine normal operating temperature idle speed positions essentially closing the induction passage. Similarly, if the temperature should decrease, the force of the thermostatic spring 68, as modulated by spring 76, exerts a closing force on the choke valve 28 and fast idle cam 86 by urging the levers 46 and 58 in a counterclockwise direction to gradually close the choke valve and also reposition the fast idle cam towards its high cam step 102 setting upon disengaging of the screw 112 from the cam face engaged and reengagement with step 102.

It should be understood that during all engine operations, the air load on the choke valve will normally cause the link 48 and pin 52 to be located at the upper edge of the slot 54 in lever 46. Therefore, regardless of whether the lever is moving clockwise or counterclockwise, the air load on the choke valve will maintain the end 52 in the position indicated.

An additional feature provided by the construction is to provide a maintained fast idle speed position of the throttle valve for a period of time even though the choke valve is rotated to its wide open position. This permits larger volume air flow at temperature levels which in a conventional carburetor would close down the throttle valves to their normal idle speed position. When thermostatic spring 68 has rotated levers 46 and 58 to a position where choke valve 28 is positioned in the vertical or open position, fast idle throttle lever screw 112 will still be in a position engaging the lower cam step 106, thus providing additional fast idle air flow. Further rotation of lever 46 by the thermostatic spring 68 is permitted by the end 52 of the choke lever link 48 moving the length of the slot 54 from top to bottom. This small movement, which amounts to approximately 14°, is sufficient to permit the fast idle cam to rotate to a position wherein the screw 112 will then align with the opening 110 and finally permit the throttle valves to close to their normal engine idle close positions.

Upon engine shutdown, the parts will take the positions determined by the thermostatic spring 68 and modulating spring 76. The fast idle cam 86 will be repositioned according to the position of the springs, and will be eccentrically rotated clockwise about the axis of rotation 122 by the servo spring 152, to reposition the throttle valve screw 112 for an opening of the throttle valves in proportion to that called for by the position of the thermostatic spring 68 and modulating spring 76.

It will be understood that the starting of the engine under conditions that are warmer than the coldest conditions described will locate the choke valve 28 and fast idle cam 86 for greater choke openings and less engine speeds, respectively, in proportion to the richness of the air/fuel ratio and engine speed called for by that particular temperature level. That is, as the engine warms, the air/fuel ratio will become progressively leaner for starting purposes, and the engine speed need be less since the friction and viscosity of the lubricant, etc., is correspondingly less.

From the foregoing, it will be seen that a carburetor has been described that provides a choke plate pull-close solenoid for starting purposes, improved pull-down modulation, an eccentrically mounted fast idle cam for automatic gradual speed reduction after engine startup, and continued fast idle cam operation subsequent to choke valve inoperativeness.

While the invention has been shown and described in its preferred embodiment, it will be clear to those skilled in the arts to which it pertains, that many changes and modifications may be made thereto without departing from the scope of the invention.

We claim:

1. A choke valve positioner for use with a carburetor having an air/fuel induction passage open at one end and adapted to be connected to an engine intake manifold at the other end, an air movable choke valve unbalance mounted to fall by gravity from a closed position across the passage to a wide open position to control air flow through the passage, movable lever means operatively connected to the choke valve for positioning the same, first thermostatic spring means operably connected to the lever means biasing the lever means and choke valve towards the closed position with a force increasing as a function of decreases in the temperature of the spring means from a predetermined level, second spring means biasing the lever means and the choke valve towards an open position in opposition to the first spring means, adjustable stop means in the path of movement of the lever means in a choke valve closing direction to stop movement of the choke valve by the lever means in the choke closing direction, lost motion means connecting the choke valve and lever means permitting relative movement therebetween whereby the choke valve can be moved to a first position less open than a second position attained by movement of the choke valve by the lever means and whereby the choke valve can fall by gravity from the less open first position to the second position dictated by the position of the lever means, and, actuation means to move the choke valve to the less open position.

2. A choke valve positioner as in claim 1, wherein the lever means is a bellcrank-like lever having first and second leg portions extending in opposite directions from a pivot fulcrum, means engaging the first spring means with the first leg portion and the second spring means with the second leg portion for biasing the lever in opposite directions.

3. A choke valve positioner as in claim 1, the second spring means comprising a force modulating spring having an initial height null force position and a changed height force position, the movement of the lever means by the thermostatic spring means in the choke opening direction moving the spring from the changed height force position to the null height position to modulate the effect of the thermostatic spring means force on the lever means and choke valve.

4. A choke valve positioner as in claim 2, the lost motion means comprising a pin and slot connection permitting movement of the lever against the stop means to position the choke valve in the second position and further movement of the choke valve to the first position by the actuation means and the movement of the choke valve by gravity from the first position to the second position.

5. A choke valve positioner as in claim 3, including ajustable means to vary the initial force position of the modulating spring.

6. A choke valve positioner for use with a carburetor having an air/fuel induction passage open at one end and adapted to be connected to an engine intake manifold at the other end for subjecting the passage to varying manifold vacuum, the choke system including an unbalance mounted, air movable choke valve rotatably mounted to fall by gravity from a closed position extending across the passage to a wide open position to control air flow through the passage, linkage means connected to the choke valve, a rotatable bellcrank lever, lost motion means connecting the lever and linkage means permitting a limited rotation of the choke valve relative to the lever and vice-versa, a thermostatic coiled spring having an arcuately movable portion connected to the lever urging the lever and choke valve towards a closed position with a force increasing as a function of decreases in the temperature of the coiled spring from a predetermined level, selectively operable actuator means connected to the choke valve for moving the choke valve towards a closed position beyond the position to which the choke valve is urged by the coiled spring through the lost motion means, the lever having first and second leg portions extending to opposite sides of a pivot fulcrum, adjustable stop means in the path of movement of the first leg portion in a choke valve closing direction to stop the movement of the lever by the coiled spring and thereby predetermine the minimum choke valve open position attained by the choke valve upon inoperativeness of the actuator means, and second spring means connected to the second leg portion in opposition to the coiled spring bias to urge the lever and choke valve in a choke valve opening direction.

7. A choke valve positioner as in claim 6, the second spring comprising a force modulating spring to modulate the effect of the coiled spring as a function of movement of the coiled spring and thereby temperature of the coiled spring, the modulating spring being movable between an initial dead height no force position and a varied height force position as a function of the position of the lever.

8. A choke valve positioner as in claim 7, including adjustable means operable on the force modulating spring to vary the modulating effect of the force modulating spring.

* * * * *